US009127229B2

(12) United States Patent
Van Houten

(10) Patent No.: US 9,127,229 B2
(45) Date of Patent: Sep. 8, 2015

(54) TRUNK PISTON ENGINE LUBRICATING OIL COMPOSITIONS

(75) Inventor: Wilhelmus P. A. Van Houten, Prinsenbeek (NL)

(73) Assignee: Cherron Oronite Technology B.V., Rotterdam (NL)

( * ) Notice: Subject to any disclaimer, the term of this patent is extended or adjusted under 35 U.S.C. 154(b) by 463 days.

(21) Appl. No.: 12/460,769

(22) Filed: Jul. 24, 2009

(65) Prior Publication Data

US 2011/0021395 A1 Jan. 27, 2011

(51) Int. Cl.
*C10M 101/02* (2006.01)
*C10M 111/04* (2006.01)

(52) U.S. Cl.
CPC ..... *C10M 101/02* (2013.01); *C10M 111/04* (2013.01); *C10M 2203/1025* (2013.01); *C10M 2203/1065* (2013.01); *C10M 2203/1085* (2013.01); *C10M 2205/173* (2013.01); *C10M 2207/028* (2013.01); *C10M 2207/262* (2013.01); *C10M 2215/28* (2013.01); *C10M 2223/045* (2013.01); *C10N 2230/08* (2013.01); *C10N 2230/10* (2013.01); *C10N 2230/52* (2013.01); *C10N 2240/102* (2013.01)

(58) Field of Classification Search
CPC ..... C10M 105/04
USPC ..... 508/460, 502, 538, 110, 200
See application file for complete search history.

(56) References Cited

U.S. PATENT DOCUMENTS

| | | | | |
|---|---|---|---|---|
| 5,520,832 | A * | 5/1996 | Alexander | 508/469 |
| 5,616,543 | A | 4/1997 | Cook | |
| 5,792,735 | A | 8/1998 | Cook et al. | |
| 6,277,794 | B1 * | 8/2001 | Dunn | 508/199 |
| 6,372,696 | B1 | 4/2002 | Tipton | |
| 6,521,571 | B1 * | 2/2003 | Garner et al. | 508/359 |
| 7,053,027 | B2 | 5/2006 | Chambard et al. | |
| 7,179,365 | B2 | 2/2007 | Aldous et al. | |
| 7,670,996 | B2 | 3/2010 | Daniel et al. | |
| 2001/0049343 | A1 * | 12/2001 | Alexander | 508/110 |
| 2003/0195126 | A1 | 10/2003 | Boons | |
| 2004/0102335 | A1 * | 5/2004 | Carrick et al. | 508/192 |
| 2004/0222129 | A1 * | 11/2004 | Aldous et al. | 208/49 |
| 2008/0039349 | A1 | 2/2008 | Dodd et al. | |
| 2009/0093387 | A1 | 4/2009 | Bertram et al. | |

FOREIGN PATENT DOCUMENTS

| | | | |
|---|---|---|---|
| EP | 0994174 | A1 | 4/2004 |
| JP | 10121082 | A | 5/1998 |
| JP | 0436391 | A2 | 8/2002 |
| JP | 2005263860 | A | 9/2005 |
| WO | 2007027782 | A1 | 3/2007 |
| WO | 2008102114 | | 8/2008 |
| WO | WO 2008/102114 | | 8/2008 |
| WO | 2009025844 | A2 | 2/2009 |

OTHER PUBLICATIONS

Watts et al., "The Benefits of Salicylate Detergents in TPEO Applications with a Variety of Base Stocks", Proceedings of the 7th International Symposium on Marine Engineering, Tokyo, Oct. 24-28, 2005.

International Search Report issued in counterpart Singapore Patent Appln. No. 201005275-1.

Anonymous: "Hygold 60 Naphthenic Base Oil Marketing Specification", Mar. 30, 2011, Retrieved from the internet: URL:http://www.ergoneurope.com/files/naphthenic/MS_HYGOLD_60_ISO_3-31-11.pdf.

International Search Report issued in corresponding European Application No. 10170598.6 dated Jul. 30, 2012.

Japanese Office Action issued in counterpart Japanese Patent Application No. 2010-166183 dated Mar. 4, 2014.

* cited by examiner

*Primary Examiner* — Prem C Singh
*Assistant Examiner* — Francis C Campanell

(57) ABSTRACT

A trunk piston engine lubricating oil composition comprising (a) a major amount of a base stock comprising at least 90% by weight saturated hydrocarbons; and (b) a minor amount of a base oil having a viscosity index of less than 70 and a cycloaliphatic hydrocarbon content of at least about 25 wt. % is disclosed.

15 Claims, No Drawings

TRUNK PISTON ENGINE LUBRICATING OIL COMPOSITIONS

BACKGROUND OF THE INVENTION

1. Technical Field

The present invention generally relates to trunk piston engine lubricating oil compositions.

2. Description of the Related Art

Trunk piston engines operate using various types and qualities of diesel fuels and heavy fuel oils. These fuels typically contain high concentrations of asphaltenes, generally the heaviest and most polar fraction of petroleum distillate. Asphaltenes are highly complex compounds believed to be composed of polyaromatic sheets containing alkyl side chains, and are generally insoluble in lubricating oils. When heavy fuel oils and conventional lubricant oil compositions mix in different temperature regions of a trunk piston engine, black sludge (such as asphaltene deposits or other deposits) and other asphaltene derived deposits (such as undercrown deposits) tend to form. The formation of black sludge or deposit can adversely affect the service interval and maintenance cost of the trunk piston engine.

Presently, there is a move in the industry in different regions of the world to replace Group I base oils with Group II base oils in trunk engine oils. Group II base oils generally have a lower aromatic content than Group I base oils, thereby resulting in a loss of heavy fuel oil (also known as residual fuel oil) compatibility when Group II or higher base oils are used in trunk piston engine lubricating oils rather than Group I base oils. It is believed that this loss of heavy fuel oil compatibility is due to the much lower solubility of asphaltenes in the Group II or higher base oils compared to Group I base oils. Generally, the problem of the loss of heavy fuel oil compatibility has been typically addressed by increasing the amount of detergent-containing trunk piston engine lubricating oil additive packages.

U.S. Patent Application Publication No. 20080039349 ("the '349 application") discloses a lubricating oil composition containing (a) an oil of lubricating viscosity; (b) at least one overbased metal detergent; and (c) at least one substituted diaryl compound. The '349 application further discloses that the lubricating oil composition exhibits improved asphaltene dispersancy in a trunk piston diesel engine.

U.S. Patent Application Publication No. 20090093387 ("the '387 application") discloses a lubricating oil composition containing (a) a Group II basestock, and (b) a neutral or overbased metal hydrocarbyl-substituted hydroxybenzoate detergent having a basicity index of less than 2. The '387 application further discloses that the neutral or overbased metal salicylate detergent having a basicity index of less than 2 improves asphaltene dispersancy in Group II basestocks.

WO2008102114 ("the '114 application") discloses a liquid lubricant base oil composition useful for a 2-stroke marine diesel engine cylinder oil, a 2-stroke marine diesel engine system oil, and a 4-stroke marine diesel engine. The lubricant base oil composition disclosed in the '114 application contains (a) a base stock comprising at least 95 wt. % saturated hydrocarbons, and (b) 0.2 to 30 wt. % of an aromatic (brightstock) extract. A bright stock is a high viscosity base oil which has been conventionally produced from residual stocks or bottoms and has been highly refined and dewaxed. The '114 application further discloses that the combination of a Group II base oil and a low polycyclic aromatic brightstock extract demonstrated improved viscosity ratio and improved oxidation and wear performance.

It would be desirable to develop a trunk piston engine lubricating oil composition containing a base stock containing at least 90% by weight saturated hydrocarbons, which exhibits improved heavy fuel oil compatibility.

SUMMARY OF THE INVENTION

In accordance with one embodiment of the present invention, a trunk piston engine lubricating oil composition is provided comprising (a) a major amount of a base stock containing at least 90% by weight saturated hydrocarbons; and (b) a minor amount of a base oil having a viscosity index (VI) of less than 70 and a cycloaliphatic hydrocarbon content of at least about 25 wt. %.

In accordance with a second embodiment of the present invention, a trunk piston engine lubricating oil composition is provided comprising (a) a major amount of a base stock containing at least 90% by weight saturated hydrocarbons; and (b) a minor amount of a base oil having a VI of less than 70 and a cycloaliphatic hydrocarbon content of at least about 25 wt. %, wherein the trunk piston engine lubricating oil composition is substantially free of a Group I base oil.

In accordance with a third embodiment of the present invention, there is provided a method for improving heavy fuel oil compatibility of a trunk piston engine lubricating oil composition comprising a major amount of a base stock containing at least 90% by weight saturated hydrocarbons, the method comprising adding a minor amount of a base oil having a VI of less than 70 and a cycloaliphatic hydrocarbon content of at least about 25 wt. % to the trunk piston engine lubricating oil composition.

In accordance with a fourth embodiment of the present invention, there is provided a method for operating a trunk piston engine comprising lubricating the trunk piston engine with a trunk piston engine lubricating oil composition comprising (a) a major amount of a base stock containing at least 90% by weight saturated hydrocarbons; and (b) a minor amount of a base oil having a VI of less than 70 and a cycloaliphatic hydrocarbon content of at least about 25 wt. %.

In accordance with a fifth embodiment of the present invention, the use of a base oil having a VI of less than 70 and a cycloaliphatic hydrocarbon content of at least about 25 wt. % for the purpose of improving heavy fuel oil compatibility of a trunk piston engine lubricating oil composition comprising a major amount of a base stock containing at least 90% by weight saturated hydrocarbons is provided.

The addition of a base oil having a VI of less than 70 and a cycloaliphatic hydrocarbon content of at least about 25 wt. % to a trunk piston engine lubricating oil composition comprising a major amount of a base stock containing at least 90% by weight saturated hydrocarbons advantageously improves the heavy fuel oil compatibility of the trunk piston engine lubricating oil composition. In addition, the trunk piston engine lubricating oil compositions of the present invention exhibit less black sludge formation than a trunk piston engine lubricating oil composition containing only a base stock containing at least 90% by weight saturated hydrocarbons. Further, the trunk piston engine lubricating oil compositions of the present invention exhibit less black sludge formation and improved oxidation resistance than a the trunk piston engine lubricating oil compositions of the present invention containing the combination of a base stock containing at least 90% by weight saturated hydrocarbons and a brightstock.

DETAILED DESCRIPTION OF THE PREFERRED EMBODIMENTS

The present invention is directed to a trunk piston engine lubricating oil composition is provided comprising (a) a major amount of a base stock containing at least 90% by weight saturated hydrocarbons; and (b) a minor amount of a base oil having a VI of less than 70 and a cycloaliphatic hydrocarbon content of at least about 25 wt. %. The base stock containing at least 90% by weight saturated hydrocarbons is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition.

The base stock containing at least 90% by weight saturated hydrocarbons may contain one or more Group II base oils and/or one or more Group III base oils and/or a base stock derived from a Fischer-Tropsch synthesized, waxy, paraffinic hydrocarbon material. A Group II base oil and/or Group III base oil can be any petroleum derived base oil of lubricating viscosity as defined in API Publication 1509, 14th Edition, Addendum I, December 1998. API guidelines define a base stock as a lubricant component that may be manufactured using a variety of different processes. Group II base oils generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270). Group III base oils generally have less than 300 ppm sulfur, a saturates content greater than 90 weight percent, and a VI of 120 or greater. In one embodiment, the base stock contains at least about 95% by weight saturated hydrocarbons. In another embodiment, the base stock contains at least about 99% by weight saturated hydrocarbons. In one preferred embodiment, the base stock containing at least 90% by weight saturated hydrocarbons or at least about 95% by weight saturated hydrocarbons or at least about 99% by weight saturated hydrocarbons is one or more Group II base oils.

The second component of the trunk piston engine lubricating oil composition is a base oil having a VI of less than 70, preferably less than about 35 and most preferably less than about 15 and a cycloaliphatic hydrocarbon content of at least about 25 wt. %. The term "cycloaliphatic hydrocarbon content" as used herein shall be understood to mean the amount of cycloaliphatic hydrocarbons as a percentage of the total carbon content of the base oil, according to standard test ASTM D 2140. The cycloaliphatic hydrocarbon is preferably a naphthenic base oil having a naphthenic carbon content of at least about 25 wt. %, wherein 'naphthenic carbon content' is defined as the amount of naphthenic carbon as a percentage of the total carbon content of the base oil, according to standard test ASTM D 2140. In one embodiment, the cycloaliphatic hydrocarbon content of the base oil is at least about 30 wt. %. In another embodiment, the cycloaliphatic hydrocarbon content of the base oil is from about 25 to about 55 wt. %. In another embodiment, the cycloaliphatic hydrocarbon content of the base oil is from about 30 to about 55 wt. %. In one preferred embodiment, a base oil as component (b) of the trunk piston engine lubricating oil composition of the present invention has a VI of less than about 35 and a cycloaliphatic hydrocarbon content of from about 30 to about 55 wt. %.

The foregoing base oils having a VI of less than 70 and a cycloaliphatic hydrocarbon content of at least about 25 wt. % are either commercially available from such sources as San Joaquin Refining Company, Inc., e.g., RAFFENE® 750L and the like, or can be prepared by any method known in the art, e.g., U.S. Pat. No. 7,179,365.

The base oil having a VI of less than 70 and at least about 25 wt. % cycloaliphatic hydrocarbon content is typically present in a minor amount, e.g., an amount ranging from about 5 to about 45 and preferably from about 10 to about 40 wt. %, based on the total weight of the trunk piston engine lubricating oil composition.

The trunk piston engine lubricating oil compositions of the present invention can have any total base number (TBN) that is suitable for use in trunk piston engines. The term "total base number" or "TBN" refers to the amount of base equivalent to milligrams of KOH in 1 gram of sample. Thus, higher TBN numbers reflect more alkaline products and therefore a greater alkalinity reserve. The TBN of the trunk piston engine lubricating oil compositions can be measured by any suitable method, such as by ASTM D2896. In general, the trunk piston engine lubricating oil compositions can have a TBN of at least about 12 and preferably from about 20 to about 60 and most preferably from about 30 to about 50.

The trunk piston engine lubricating oil compositions of the present invention can have any viscosity that is suitable for use in a trunk piston engine. Generally, the trunk piston engine lubricating oil composition can have a viscosity ranging from about 5 to about 25 centistokes (cSt) at 100° C. and preferably from about 10 to about 20 cSt at 100° C. The viscosity of the trunk piston engine lubricating oil composition can be measured by any suitable method, e.g., ASTM D2270.

The trunk piston engine lubricating oil compositions of the present invention can be prepared by any method known to a person of ordinary skill in the art for making trunk piston engine lubricating oils. The ingredients can be added in any order and in any manner. Any suitable mixing or dispersing equipment may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., a Gaulin homogenizer or Rannie homogenizer), a mill (e.g., colloid mill, ball mill or sand mill) or any other mixing or dispersing equipment known in the art.

In one embodiment, the trunk piston engine lubricating oil compositions of the present invention are substantially free of a Group I base oil. The term "substantially free" as used herein shall be understood to mean relatively little to no amount of any Group I base oil, e.g., an amount less than about 5 wt. %, preferably less than 1 wt. %, and most preferably less than 0.1 wt. %, based on the total weight of the trunk piston engine lubricating oil composition. The term "Group I base oil" as used herein refers to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

In one preferred embodiment, the trunk piston engine lubricating oil compositions of the present invention reduce black sludge (or black sludge deposit) formation in an engine such as an engine using a heavy fuel oil, e.g., an asphaltene-containing heavy fuel oil, by at least about 5%, preferably at least about 10%, more preferably at least about 20% and most preferably at least about 30% when compared to a trunk piston engine lubricating oil composition containing a major amount of a Group II base oil and a minor amount of a brightstock.

The trunk piston engine lubricating oil compositions of the present invention may also contain conventional trunk piston engine lubricating oil composition additives for imparting auxiliary functions to give a finished trunk piston engine lubricating oil composition in which these additives are dispersed or dissolved. For example, the trunk piston engine lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and the like and mixtures thereof. A variety of the additives are known and commercially available. These additives, or their analogous compounds, can be employed for the preparation of the trunk piston engine lubricating oil compositions of the invention by the usual blending procedures.

Examples of antioxidants include, but are not limited to, aminic types, e.g., diphenylamine, phenyl-alpha-napthylamine, N,N-di(alkylphenyl)amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic)phenol; and mixtures thereof.

Examples of ashless dispersants include, but are not limited to, polyalkylene succinic anhydrides; non-nitrogen containing derivatives of a polyalkylene succinic anhydride; a basic nitrogen compound selected from the group consisting of succinimides, carboxylic acid amides, hydrocarbyl monoamines, hydrocarbyl polyamines, Mannich bases, phosphonoamides, and phosphoramides; triazoles, e.g., alkyltriazoles and benzotriazoles; copolymers which contain a carboxylate ester with one or more additional polar function, including amine, amide, imine, imide, hydroxyl, carboxyl, and the like, e.g., products prepared by copolymerization of long chain alkyl acrylates or methacrylates with monomers of the above function; and the like and mixtures thereof. The derivatives of these dispersants, e.g., borated dispersants such as borated succinimides, may also be used.

Examples of antiwear agents include, but are not limited to, zinc dialkyldithiophosphates and zinc diaryldithiophosphates, e.g., those described in an article by Born et al. entitled "Relationship between Chemical Structure and Effectiveness of Some Metallic Dialkyl- and Diaryl-dithiophosphates in Different Lubricated Mechanisms", appearing in Lubrication Science 4-2 January 1992, see for example pages 97-100; aryl phosphates and phosphites, sulfur-containing esters, phosphosulfur compounds, metal or ash-free dithiocarbamates, xanthates, alkyl sulfides and the like and mixtures thereof.

Examples of detergents include, but are not limited to, overbased or neutral detergents such as sulfonate detergents, e.g., those made from alkyl benzene and fuming sulfuric acid; phenates (high overbased or low overbased), high overbased phenate stearates, phenolates, salicylates, phosphonates, thiophosphonates, ionic surfactants and the like and mixtures thereof. Low overbased metal sulfonates typically have a total base number (TBN) of from about 0 to about 30 and preferably from about 10 to about 25. Low overbased metal sulfonates and neutral metal sulfonates are well known in the art.

In one preferred embodiment, the trunk piston engine lubricating oil compositions of the present invention contain one or more overbased alkaline earth metal hydrocarbyl-substituted hydroxyl benzoate detergents having a TBN of about 10 to about 450 such as overbased alkaline earth metal alkylhydroxy benzoate detergents having a TBN of about 10 to about 450. Generally, the detergents can be present in the trunk piston engine lubricating oil compositions in amount of about 1 to about 15 wt. %, based on the total weight of the trunk piston engine lubricating oil composition.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof.

Examples of antifoaming agents include, but are not limited to, polymers of alkyl methacrylate; polymers of dimethylsilicone and the like and mixtures thereof.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the lubricating oil composition.

If desired, the trunk piston engine lubricating oil additives may be provided as an additive package or concentrate in which the additives are incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will typically contain one or more of the various additives, referred to above, in the desired amounts and ratios to facilitate direct combination with the requisite amount of the base stock containing at least 90% by weight saturated hydrocarbons and base oil having a viscosity index of less than 70 and at least about 25 wt. % cycloaliphatic hydrocarbon content. The trunk piston engine lubricating oil compositions of the present invention may be suitable for use in a 4-stroke trunk piston engine having an engine speed of about 200 to about 2,000 rotations per minute (rpm), e.g., about 400 to about 1,000 rpm, and a brake horse-power (BHP) per cylinder of about 50 to about 5,000, preferably about 100 to about 3,000 and most preferably from about 100 to about 2,000. Engines used for auxiliary power generation applications or in land-based power generation applications are also suitable.

The following non-limiting examples are illustrative of the present invention.

EXAMPLES 1 AND 2 AND COMPARATIVE EXAMPLES A-C

Trunk piston engine lubricating oil compositions were prepared as set forth below in Table 1. Each trunk piston engine lubricating oil composition was an SAE 40 viscosity grade with a TBN of 40 mg KOH/g. The trunk piston engine lubricating oil compositions of Examples 1 and 2 (within the scope of the invention) were formulated with the combination of a Group II base oil and a naphthenic base oil whereas the trunk piston engine lubricating oil compositions of Comparative Examples A-C (outside the scope of the invention) were formulated as follows: a Group II base oil alone (Comparative Example A), and the combination of a Group II base oil and a brightstock (Comparative Examples B and C). A description of the various base oils used in the trunk piston engine lubricating oil compositions is set forth below in Table 2.

The trunk piston engine lubricating oil compositions of Examples 1 and 2 and Comparative Examples A-C were tested for the amount of black sludge formation in the Black Sludge Deposit (BSD) Test. In the BSD Test, a sample of test oil was mixed with heavy fuel oil to form a test mixture. Each test mixture was pumped over a heated test plate for a specified period of time. After cooling and washing, test plates were dried and weighed. The weight of each steel test plate was determined, and the weight of the deposit remaining on the steel test plate was measured and recorded as the change in weight of the steel test plate. The results of the BSD test are set forth below in Table 1.

The trunk piston engine lubricating oil compositions of Examples 1 and 2 and Comparative Examples A-C were also tested for oxidation stability in the Pressure Differential Scanning Calorimetry (PDSC) Test. In the PDSC Test (ASTM D 6186), the oxidation stability of oils is measured by detecting the exothermic release of energy that occurs when oils succumb to auto-oxidation. Test oils were held 130° C. under 500 psi of oxygen pressure. The length of time required to reach auto-oxidation is a measure of oxidation resistance and is known as oxidation induction time. The results of the PDSC test are set forth below in Table 1.

TABLE 1

| Formulations | Comp. Ex. A (wt. %) | Comp. Ex. B (wt. %) | Ex. 1 (wt. %) | Comp. Ex. C (wt. %) | Ex. 2 (wt. %) |
|---|---|---|---|---|---|
| Additives: | | | | | |
| 350 TBN Ca alkylhydroxy benzoate | 9.64 | 9.64 | 9.64 | 9.64 | 9.64 |
| 140 TBN Ca alkylhydroxy benzoate/alkyl phenate | 5.43 | 5.43 | 5.43 | 5.43 | 5.43 |
| Succinimide dispersant | 1.00 | 1.00 | 1.00 | — | — |
| ZnDTP | 0.71 | 0.71 | 0.71 | 0.71 | 0.71 |
| Foam inhibitor | — | 0.04 | 0.04 | 0.04 | 0.04 |
| Group II base oil (RLOP 220R) | — | 20.00 | — | 20.00 | — |
| Group II base oil (RLOP 600R) | 83.22 | 43.18 | 63.18 | 44.18 | 64.18 |
| Brightstock | — | 20.00 | — | 20.00 | — |
| Naphthenic base oil | — | — | 20.00 | — | 20.00 |
| Bench Test Results: | | | | | |
| Black sludge deposits (mg) | 84 | 41.1 | 17.1 | 17.9 | 12.4 |
| PDSC Ox. Induction Time 1 (min) | — | 28.6 | 29.7 | 28.3 | 29.5 |
| PDSC Ox. Induction Time 2 (min) | — | 28.9 | 29.7 | 28.6 | 29.5 |
| PDSC Ox. Induction Time Ave. (min) | — | 28.8 | 29.7 | 28.5 | 29.5 |

As the data show, the trunk piston engine lubricating oil compositions containing the combination of a Group II base oil and a naphthenic base oil (Examples 1 and 2) exhibited both less black sludge deposit formation and better oxidation stability than the trunk piston engine lubricating oil compositions containing a the combination of a Group II base oil and a brightstock (Comparative Examples B and C). The trunk piston lubricating oil composition containing only a Group II base oil (Comparative Example A) demonstrated significant black sludge deposit formation in comparison to all the other lubricating oil compositions.

TABLE 2

| Base Oil | API Base Oil Category | Viscosity Index | % $C_N$[4] | % $C_A$[5] | % $C_P$[6] | S (ppm) |
|---|---|---|---|---|---|---|
| RLOP 220R[1] | II | 103 | 34 | <1 | 66 | <10 |
| RLOP 600R[1] | II | 101 | 28 | <1 | 72 | <10 |
| Brightstock[2] | I | 96.5 | | 39.4 | | 9100 |
| Naphthenic[3] | V | 5 | 46 | 10 | 44 | 7420 |

[1]A Group II base oil available from Chevron Products Company.
[2]A Group II base oil available from ExxonMobil as CORE ® 2500.
[3]Available from San Jaoquin Refining Co. as RAFFENE ® 750L.
[4]Naphthenic carbon content as a percentage of the total carbon content of the base oil.
[5]Aromatic carbon content as a percentage of the total carbon content of the base oil.
[6]Paraffinic carbon content as a percentage of the total carbon content of the base oil.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A trunk piston engine lubricating oil composition comprising (a) a major amount of a base stock comprising at least a Group II base oil; and (b) about 5 to about 45 wt. %, based on the total weight of the trunk piston engine lubricating oil composition, of a base oil having a viscosity (VI) of less than about 35 and a cycloaliphatic hydrocarbon content of about 25 wt. % to about 55 wt. %.

2. The trunk piston engine lubricating oil composition of claim 1, Wherein the base stock further comprises at least one of a Group III base oil or a base stock derived from a Fischer-Tropsch synthesized, waxy, paraffinic hydrocarbon material.

3. The trunk piston engine lubricating oil composition of claim 1, wherein the base oil having a VI of less than 35 and a cycloaliphatic hydrocarbon content of about 25 wt. % to about 55 wt. % is a base oil having a VI of less than 35 and a naphthenic carbon content of about 25 wt. % to about 55 wt. %.

4. The mink piston engine lubricating oil composition of claim 1, which is substantially free of a Group I base oil.

5. The trunk piston engine lubricating oil composition of claim 3, which is substantially free of a Group I base oil.

6. The trunk piston engine lubricating oil composition of claim 1, further comprising one or more trunk piston engine lubricating oil composition additives selected from the group consisting of an antioxidant, anti-wear agent, detergent, rust inhibitor, dehazing agent, demulsifying agent, metal deactivating agent, friction modifier, pour point depressant, anti-foaming agent, co-solvent, package compatibiliser, corrosion-inhibitor, ashless dispersant, dye, extreme pressure agent and mixtures thereof.

7. The trunk piston engine lubricating oil composition of claim 1, further comprising one or more metal-containing detergents.

8. The trunk piston engine lubricating oil composition of claim 7, wherein the at least one metal-containing detergent is an overbased alkaline earth metal alkylhydroxy benzoate detergent having a total base number (TBN) of about 10 to about 450.

9. The trunk piston engine lubricating oil composition of claim 7, wherein the metal-containing detergent comprises a first metal-containing detergent having a TBN of about 150 to about 450 and a second metal-containing detergent having a TBN of about 10 to about 140.

10. A method for improving heavy fuel oil compatibility of a trunk piston engine lubricating oil composition comprising a major amount of a base stock comprising at least a Group II base oil, the method comprising adding about 5 to about 45 wt. %, based on the total weight of the trunk piston engine lubricating oil composition, of a base oil having a VI of less than about 35 and a cycloaliphatic hydrocarbon content of about 25 wt. % to about 55 wt. % to the trunk piston engine lubricating oil composition.

11. The method of claim 10, wherein the base stock further comprises at least one of a a Group III base oil or a base stock derived from a Fischer-Tropsch synthesized, waxy, paraffinic hydrocarbon material.

12. The method of claim 10, wherein the base oil having a VI of less than 35 and a cycloaliphatic hydrocarbon content of about 25 wt. % to about 55 wt. % is a base oil having a VI of less than 35 and a naphthenic carbon content of about 25 wt. % to about 55 wt. %.

13. The method of claim 10, which is substantially free of a Group I base oil.

14. The method of claim 10, wherein the trunk piston engine lubricating oil composition further comprises one or more trunk piston engine lubricating oil composition additives selected from the group consisting of an antioxidant, anti-wear agent, detergent, rust inhibitor, dehazing agent, demulsifying agent, metal deactivating agent, friction modifier, pour point depressant, antifoaming agent, co-solvent, package compatibiliser, corrosion-inhibitor, ashless dispersant, dye, extreme pressure agent and mixtures thereof.

15. A method for operating a trunk piston engine, the method comprising lubricating the trunk piston engine with a trunk piston engine lubricating oil composition comprising (a) a major amount of a base stock comprising at least a Group II base oil; and (b) about 5 to about 45 wt. %, based on the total weight of the trunk piston engine lubricating oil composition, of a base oil having a VI of less than about 35 and a cycloaliphatic hydrocarbon content of about 25 wt. % to about 55 wt. %.

* * * * *